United States Patent [19]

Trigon

[11] Patent Number: 4,531,807

[45] Date of Patent: Jul. 30, 1985

[54] BENT TERMINAL FOR ELECTRICAL CONNECTION

[75] Inventor: Jean Trigon, Dagneux, France

[73] Assignee: L'Electricfil Industrie, France

[21] Appl. No.: 386,642

[22] Filed: Jun. 9, 1982

[30] Foreign Application Priority Data

Jun. 11, 1981 [FR] France ..... 81 11885

[51] Int. Cl.[3] ..... H01R 15/12

[52] U.S. Cl. ..... 339/223 S

[58] Field of Search ..... 339/26, 223 S, 256 C, 339/256 RT, 258 C, 276 S, 276 T, 245

[56] References Cited

U.S. PATENT DOCUMENTS

| | | | |
|---|---|---|---|
| 1,672,201 | 6/1928 | Champion | 339/223 S |
| 2,835,724 | 5/1958 | Colbert | 339/26 |
| 2,974,186 | 3/1961 | Klumpp, Jr. | 174/153 |
| 3,597,723 | 8/1971 | Schmidt et al. | 339/26 |
| 3,793,616 | 2/1974 | Moehrke | 339/223 S |
| 4,009,924 | 3/1977 | Bungo et al. | 339/223 S |
| 4,073,565 | 2/1978 | Raymond | 339/245 |
| 4,268,104 | 5/1981 | Kidder | 339/245 |

FOREIGN PATENT DOCUMENTS

| | | | |
|---|---|---|---|
| 1205573 | 9/1970 | United Kingdom | 339/26 |

*Primary Examiner*—Gil Weidenfeld
*Assistant Examiner*—Gary F. Paumen
*Attorney, Agent, or Firm*—Ostrolenk, Faber, Gerb & Soffen

[57] ABSTRACT

The present invention relates to a bent terminal for electrical connection, which comprises an arm for crimping, an arm for connection and a joining portion defining an envelope of general toric form; this toric portion may be constituted by a semi-toric half-shell and by a complementary portion, affixed or connected thereto, cooperating with said half-shell to constitute the envelope. The invention is more particularly applicable to ignition wiring systems in internal combustion engines with controlled ignition.

6 Claims, 11 Drawing Figures

Fig. 9
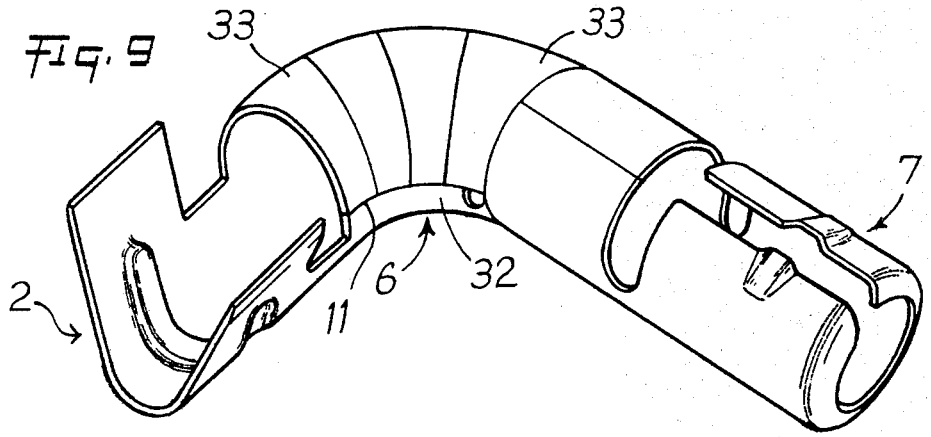
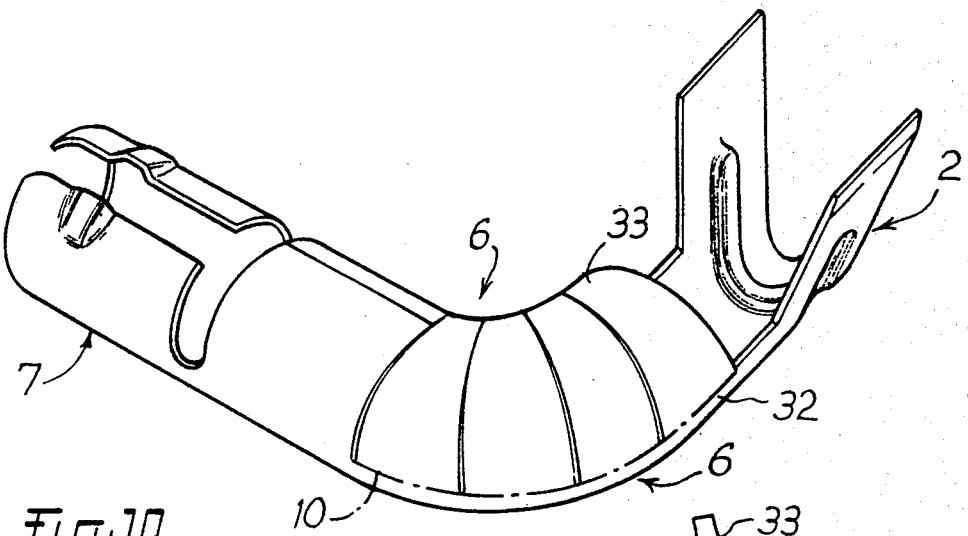
Fig. 10
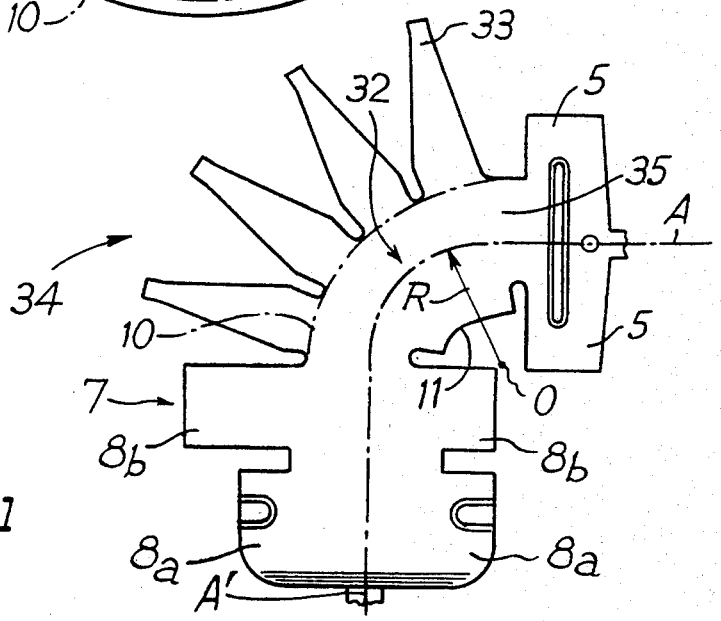
Fig. 11

BENT TERMINAL FOR ELECTRICAL CONNECTION

The present invention relates to bent terminals added to the ends of electrical conductors for ensuring connection between a source of supply and a user apparatus. The invention relates more particularly to such bent terminals used in the wiring harness of ignition systems of motors, and, more particularly still, to the ignition wiring systems of internal combustion engines with controlled ignition, particularly for automobile vehicles.

In the above technical domain, it so happens that the connection between the supply and either the coil, the distributor, or the spark plugs, is effected via bent terminals when the general dimensions or space available require this. Such terminals are completed by caps made of elastic material, such as elastomer, provided to clamp the conducting wire and the complementary connecting member of the terminal, to form an association tight to the infiltrations and projections of water and, moreover, offering electrical insulation.

Terminals which are used at present in the above-mentioned domain are elements obtained by stamping. Such terminals are in elbow form, bent as a generally right-angled "L", comprising an arm for joining with the wire of the wiring system and a connecting arm. Such a form is particularly chosen so that the terminals may also constitute traction members on which are applied the efforts which must be developed when disconnecting the wire from the coil, the distributor, or the spark plug.

Such terminals are generally satisfactory for the above functions. However, it has been observed that such terminals did not lend themselves at all to the assembly of an elastomer cap when a harness wire was made. In fact, the right-angled form prevents easy sliding of the cap on the terminal and the wire. To equip a complete wire, one of the following two methods must necessarily be adopted.

The first consists in fitting the bent cap on the conducting wire, then in crimping or adapting a terminal on the wire, then in returning the cap into position on the terminal. After these steps, the assembly is tested and if the wire thus constituted does not comply with the desired electrical characteristics, all the elements must be rejected.

Such a solution is unsatisfactory and cannot be adopted since, although one advantage resides in the simple manner of equipping the wire with a cap, the caps of the two ends of a wire represent a high cost and it cannot be envisaged to reject such an assembly.

The second solution consists in crimping the terminals at the ends of a wire, then in fitting the caps by radially deforming them sufficiently to pass the bent edge of the terminals without damage.

Although such a modus operandi can be envisaged from a technical standpoint, experience has shown that it led to imposing such a stress on the caps that at least one of the ends of the caps was permanently deformed. The functions of water-tightness and electrical insulation are thus altered thereby, to such a point as to render the wire virtually unusable. Moreover, the edge of the bent terminal forms a cutting portion provoking tearing of the cap.

Consequently, the methods known at present do not enable a wire to be equipped satisfactorily.

It is an object of the present invention to overcome the above drawbacks and, to this end, to provide a novel bent terminal for electrical connection of which the structure and form allow relatively easy sliding of the cap on the terminal, then on the cable.

The invention thus enables an ignition system wire to be made by firstly crimping the end terminals on a wire, monitoring the electrical function thereof and then equipping such a wire, if it complies with the desired standards, with the tight protecting caps.

It thus becomes possible to mass produce conducting wires, particularly for ignition systems, at a high rate, reducing possible rejects to a minimum and ensuring assembly and equipment of the elastomer caps in a rapid, reliable, and simple manner, without risk of tearing and without risk of permanent deformation altering the quality of the finished product.

It is a further object of the invention to provide a bent terminal for electrical connection which presents characteristics of mechanical strength in connection with the particular application envisaged. In other words, the object of the invention is to provide a bent terminal for electrical connection capable of withstanding a pulling effort applied to one of its arms without permanently deforming its structure, nor lowering the quality of crimping on the conducting wire or the electrical contact quality of its connecting arm.

To attain the above purpose, the invention is characterised in that the terminal comprises a joining portion formed by a tubular segment of generally toric form:

whose cross section is substantially equal to that of the connecting arm, having a radius of curvature, taken at the level of the inner generatrix, of the order of one to three times the diameter of the connecting arm, and being a continuation of said arm.

The invention will be more readily understood on reading the following description with reference to the accompanying drawings, in which:

FIGS. 7, 8 and 9 are perspective views illustrating three other possible embodiments of the invention.

FIG. 10 is a perspective view showing a detail of construction of the embodiment of FIG. 9.

FIG. 11 is a plan view illustrating a metal cut-out for forming the embodiment of FIGS. 9 and 10.

Figure 1:
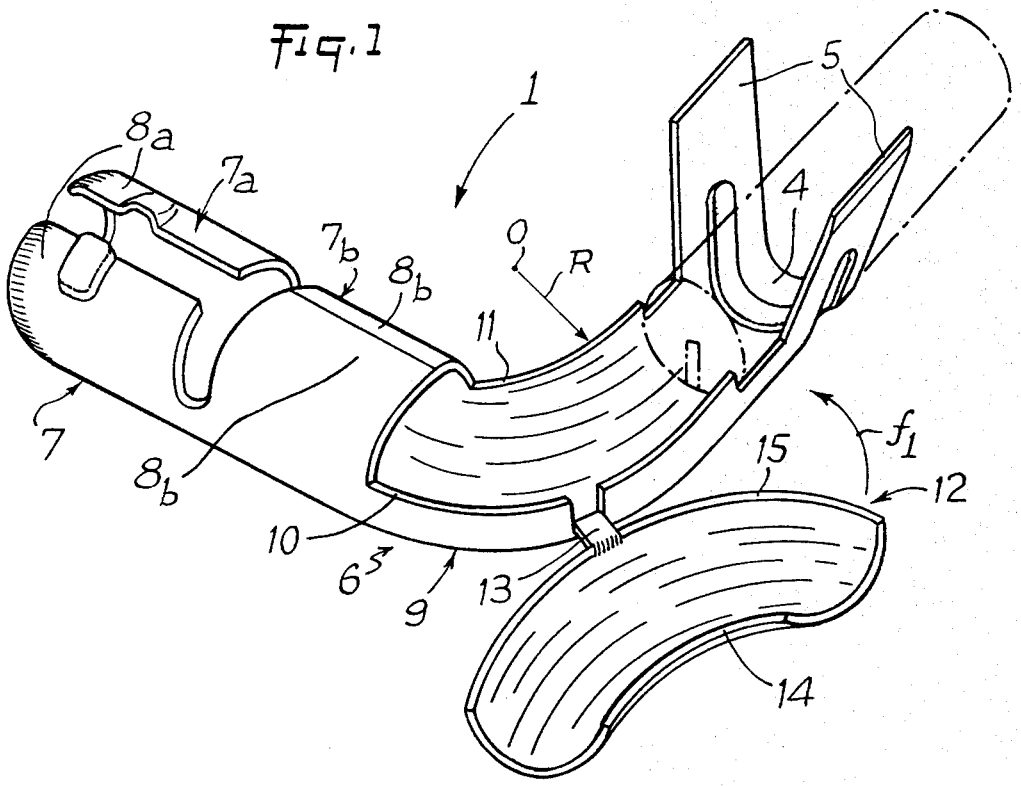
FIG. 1 is a perspective view of one of the embodiments of the invention.
Figure 2:
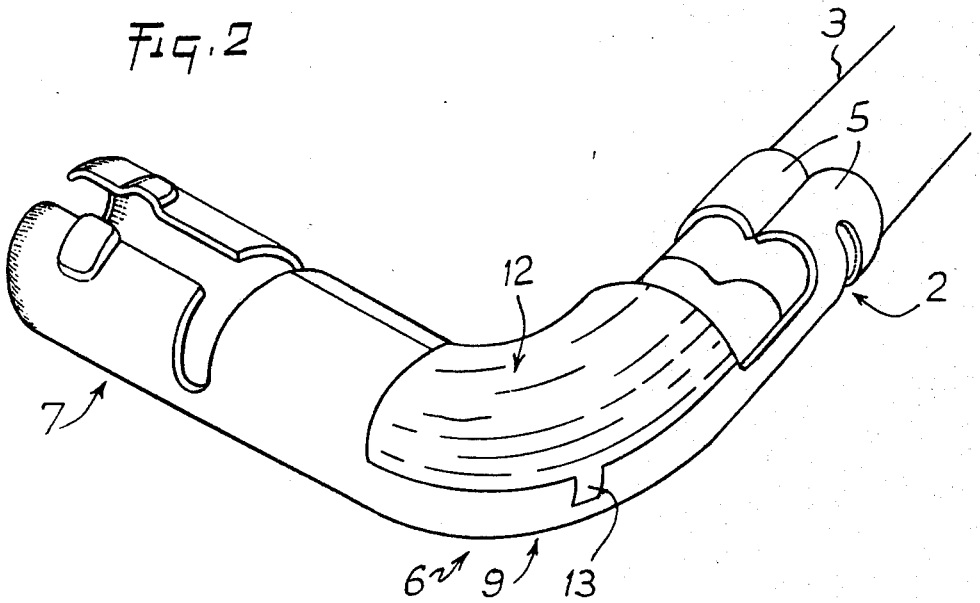
FIG. 2 is a perspective view illustrating the final position of the embodiment of FIG. 1 before use.

Referring now to the drawings, in the embodiment illustrated in FIGS. 1 and 2, the bent terminal for electrical connection, generally designated by reference 1, comprises an arm 2 to be crimped on an electrical conductor 3, such as the one shown in dashed and dotted lines and preferably forming part of the ignition system of a heat engine.

For the above-mentioned purpose, the so-called crimping arm 2 comprises a portion 4, of substantially semi-cylindrical section, extended by two crimping tabs 5 which may be folded and clamped down to ensure mechanical strength with the conductor 3 and indirectly to establish an electrical contact.

The crimping arm 2 is connected by a joining portion 6 to an arm 7 for connection to a complementary terminal (not shown). The complementary terminal may be borne in particular by a coil or distributor of a controlled ignition system of an internal combustion engine, such as those in automobiles or by the connecting terminal of a spark plug. For the above purpose, the arm 7 is preferably of the substantially tubular type comprising a portion *7a* elastically deformable radially to facilitate adaptation, assembly, holding and electrical connection with a complementary terminal which may be of the male or female type. The elastically deformable portion *7a* is constituted by two tabs *8a* which are separated with respect to two homologous tabs *8b* constituting a rigid portion *7b* connecting with the joining portion 6. Portion *7a* is thus in the form of a bush.

According to the invention, the joining portion 6 is constituted by a curved segment having, at least locally, a cross section substantially equal to that of the connecting arm 7. The curved segment is further defined by a radius R of centre O which, taken at the level of the inner radius of the torus, is of the order of one to three times the diameter of the section of the arm 7. In addition, the curved segment is preferably an exact continuation of the connecting arm 7.

According to the embodiment illustrated, the curved segment constituting the joining portion 6 is provided to define, at least locally, an envelope of general toric form. To this end, the joining portion 6 of curved segment comprises a half-shell 9, of substantially semi-cylindrical cross section which is stamped directly when the arms 2 and 7 are formed. The semi-cylindrical half-shell 9 has curved longitudinal edges 10 and 11, located in the same plane passing substantially through the base of the tabs 5 and/or *8a–8b*.

One of the edges of the half-shell 9, for example edge 10, is associated with a complementary portion constituted by a complementary half-shell 12, likewise of semi-cylindrical form, which is connected, retained or attached to the half-shell 9 via a bridge element 13. In the embodiment, the half-shell 12 is of the open, semi-tubular type and is stamped from the same blank to form the assembly described above.

With a view to forming the toric envelope, the joining portion 6 is reconstituted by folding the half-shell 12 in the direction of arrow $f_1$. This operation is effected about or in association with the bridge element 13, so as to bring the longitudinal edges 14 and 15 into abutment on and into register with the edges 10 and 11 of the half-shell 9.

This phase of reconstitution is illustrated in FIG. 2 which shows that the joining portion 6 is effectively in the form of a curved segment being a continuation of the arm 7 and defining, up to the conductor 3, a continuous toric envelope from the connecting arm 7 up to conductor 3 in the example illustrated.

The above embodiment consequently enables an elastomer cap to be fitted on the arm 7 and enables it to advance relatively to the terminal until it is partly fitted on the conductor 3. In fact, the curved segment 6 presents no projection or roughness which would require considerable distension incompatible with the elastic limit of the cap or which would act to constrain movement of the cap or to damage the cap by friction or bruising or by cutting or removing material from it.

The terminal as described hereinabove therefore makes it possible to envisage manufacture of an ignition wire by initially cutting the conductor 3 to the desired length, crimping each end of the terminal, testing the electrical properties, and then mounting the caps to complete the wire.

Figure 3:
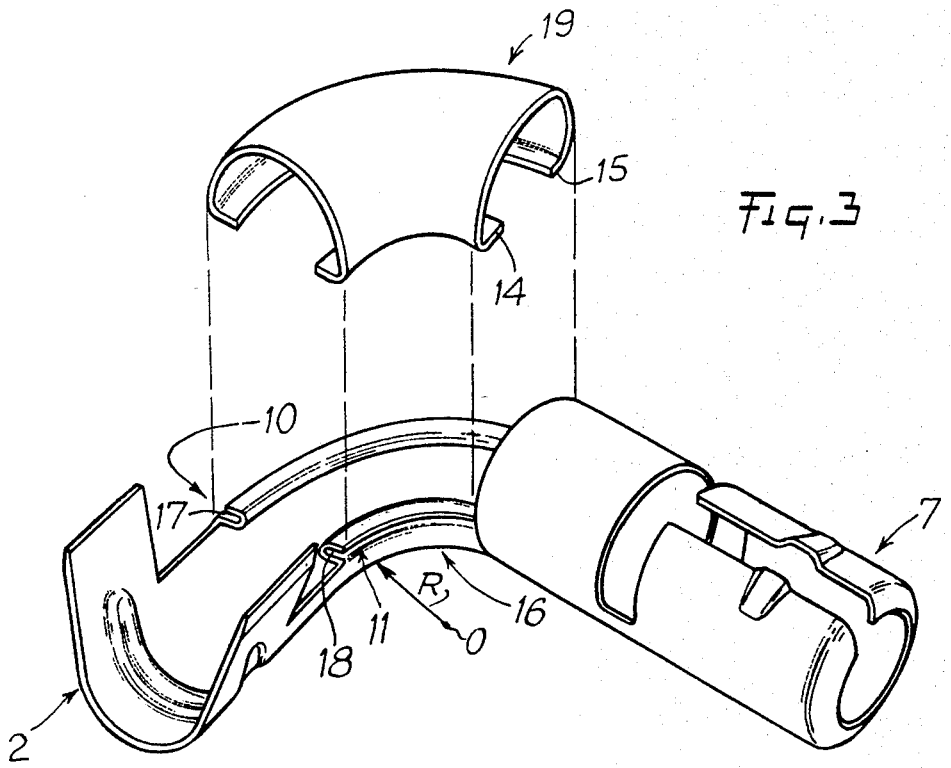
FIG. 3 is a perspective view showing a variant embodiment of the invention.
Figure 4:
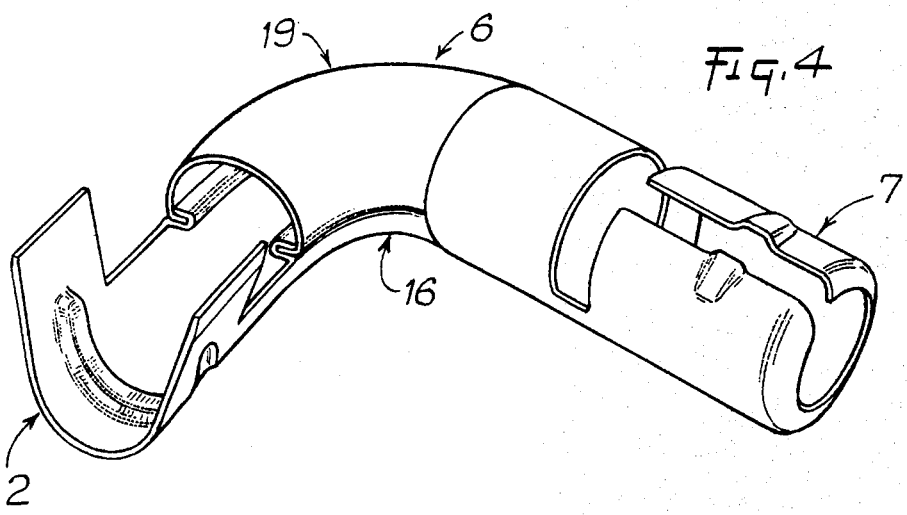
FIG. 4 is a perspective view illustrating the final position of the embodiment of FIG. 3 before use.

FIGS. 3 and 4 shows a variant embodiment in which the curved segment 6 includes a half-shell 16 of semi-tubular toric type, as stated above, between the arms 2 and 7. According to this embodiment, the edges 10 and 11 of the half-shell 16 form outwardly opening grooves 17 and 18 constituted for example by folding and counter-folding the edges 10 and 11.

The curved segment 6 also comprises a complementary portion formed by an independent half-shell 19 whose edges 14 and 15 are folded inwardly towards each other.

The two separate elements, as stated above, are fitted together by engagement of the folded edges 14 and 15 in the grooves 17 and 18, by elastic deformation either of grooves 17 and 18 or of edges 14 and 15. FIG. 4 shows that, in such an embodiment, the half-shell 19 makes it possible to reconstitute the curved segment so that it defines a toric envelope, of substantially constant section, having the same characteristics as those of the preceding example.

Figure 5:
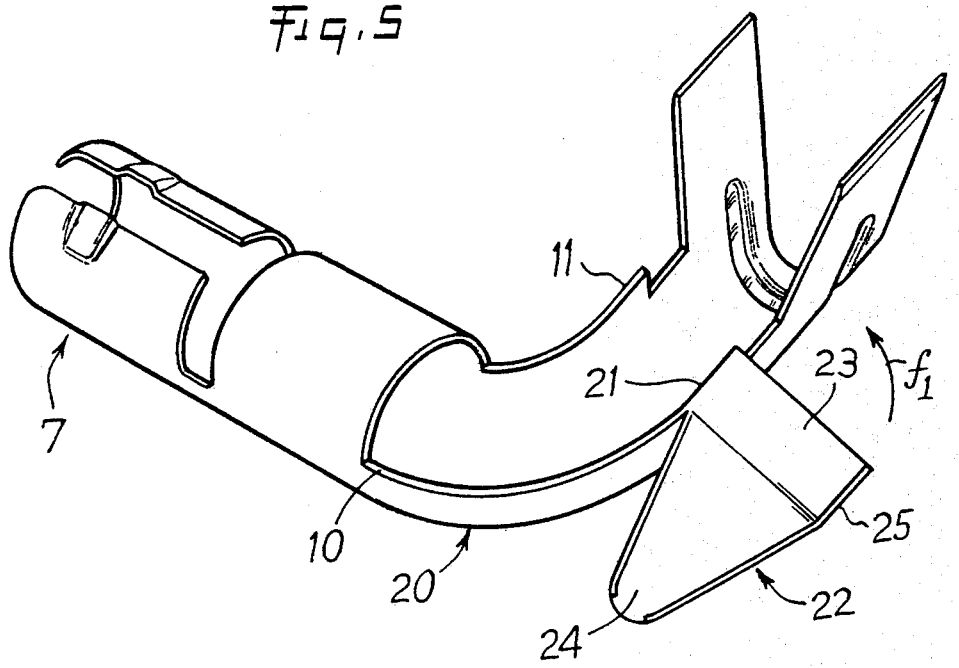
FIGS. 5 and 6 are perspective views showing an embodiment of the invention, similar to the example of FIGS. 3 and 4.
Figure 6:
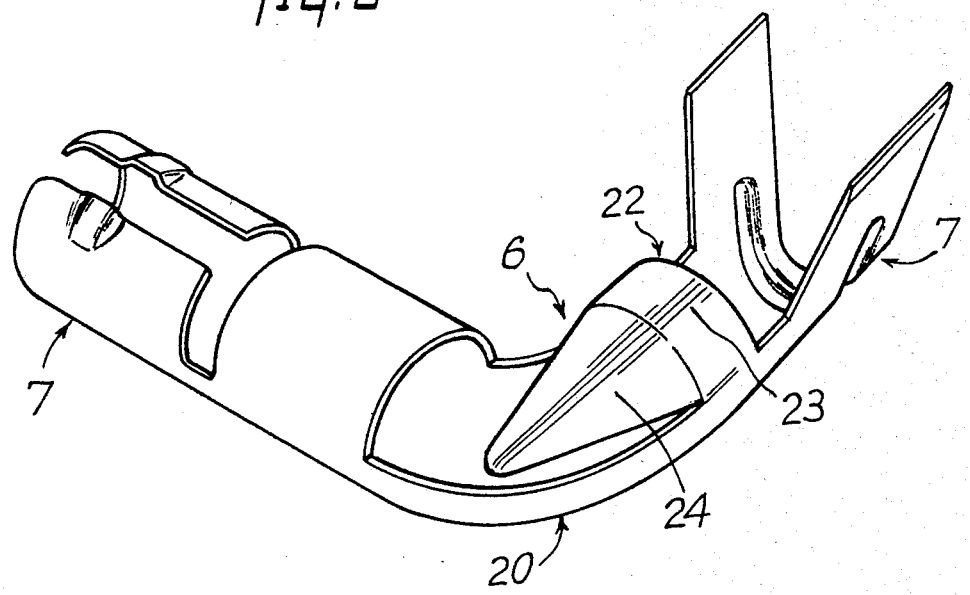

FIGS. 5 and 6 show a variant embodiment in which the curved segment 6 comprises a half-shell 20, of the type as in FIG. 1. One of the edges of the half-shell 20, for example the outer longitudinal edge 10, is associated, by a connecting bridge element 21, to a half-shell 22 comprising a semi-cylindrical, tubular portion 23 extended by a semi-truncated attachment 24 which extends in the direction opposite arm 2.

To reconstitute the segment 6 as described in the preceding examples, the half-shell 22 is folded, in the direction of arrow $f_1$, around the bridge element 21, so that the portion 23 locally reconstitutes a toric tubular envelope with the half-shell 20. In this state, shown in FIG. 6, the free longitudinal edge 25 of portion 23 comes into abutment on the inner longitudinal edge 11 of the half-shell 20.

An examination of FIG. 6 will show that, upon assembly, the advance of the cap leads it to cooperate with the attachment 24 upon engagement on the joining portion 6. The attachment 24 progressively increases the section of the segment 6 until it joins portion 23, so that the cap passes over segment 6 more easily.

Figure 7:
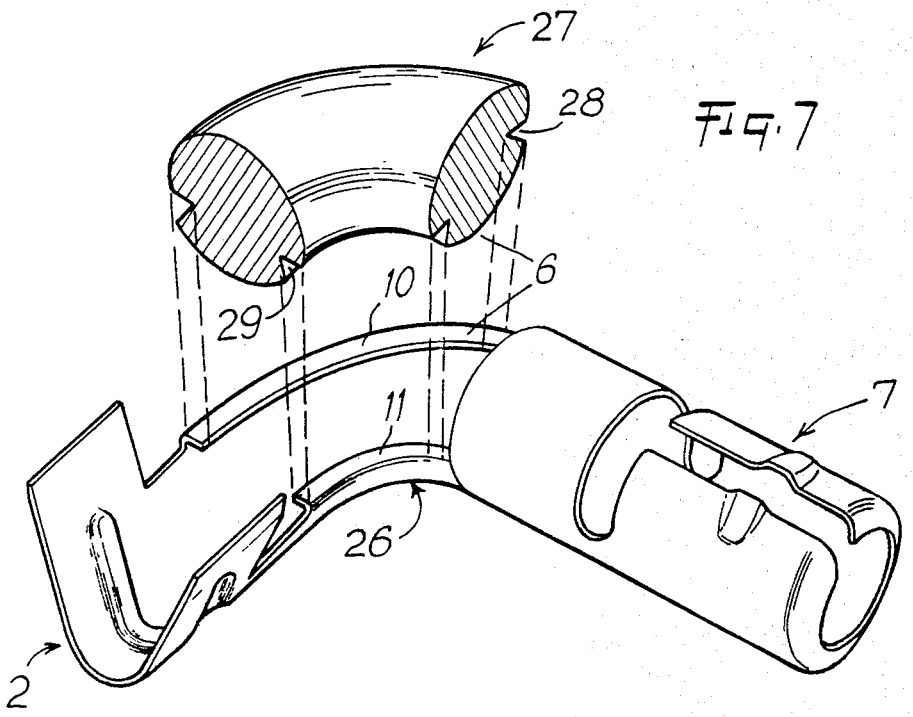

FIG. 7 shows another embodiment according to which the curved segment 6 comprises a half-shell 26, resembling half-shell 16 of FIG. 3. The half-shell 26 comprises edges 10 and 11 folded down towards each other in the diametrical plane. Reconstitution of the envelope, of substantially toric form, defining the curved segment 6, is obtained in this example by employing a complementary portion formed by a section of torus 27 made by any appropriate material, particularly a semi-rigid plastic material. The section of torus 27 comprises, in a substantially diametrical plane, two longitudinal notches 28 and 29 adapted to receive the folded edges 10 and 11. Reconstitution of the toric envelope may be obtained by axially sliding the section of torus 27 inside the half-shell 26 or by radial penetration with relative elastic deformation of the material constituting said torus and/or the edges 10 and 11. In certain cases, a complementary crimping operation may also be provided, ensuring, by permanent deformation, the engagement of the bent edges 10 and 11 inside the complementary notches 28 and 29.

Figure 8:
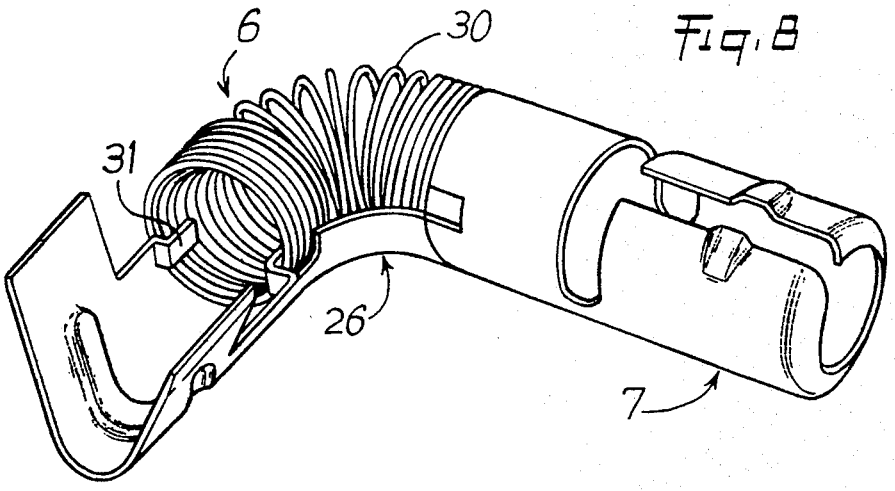

A variant embodiment is shown in FIG. 8. In this example, the element complementary of the half-shell 26 is constituted by a segment or section of helical spring 30 which is disposed inside the shell 26 and is maintained and immobilised therein in order to constitute the toric envelope constituting the curved segment 6. Immobilisation of the segment of helical spring 30 may be obtained in particular via hooks 31 which are formed, from the longitudinal edges of the half-shell 26, from the longitudinal edges of the half-shell 26, in the zones of connection between the latter and the arms 2 and 7. The helical spring, preferably chosen to perform the above function, is preferably of the type presenting contiguous turns in a state of rest and in rectilinear form.

FIGS. 9 and 10 illustrate a particularly advantageous embodiment in which the curved segment 6 still employs a half-shell 32 which is completed by tongues 33, of generally radial disposition and generally trapezoidal in form, of which the large base of each coincides with the longitudinal edge outside with respect to centre O, representing, after shaping, the edge 10 of the preceding examples. These tongues 33 are rolled and folded down on the longitudinal edge 11. FIGS. 9 and 10 show that the tongues 33 constitute, together with the half-shell 32, the toric envelope for connection between arm 7 and arm 2.

FIG. 11 shows an embodiment employing a starting blank 34 in "L" form in plan view. The blank 34 comprises, on one arm of the "L", two tabs 5 directed opposite to each other with respect to an axis of symmetry A–A′ which form the crimping arm 2 with the common portion 35. On the other arm of the "L", the common portion 35 forms the connecting arm 7 with the tabs **8*a* and 8*b*. The outer periphery of the common portion 35 between tabs 5 and 8*b* and shown in dashed and dotted lines, is extended by the radially disposed tongues 33. The tongues 33 are of such length that, after shaping and rolling to reconstitute the toric envelope, they abut exactly on the edge 11**.

It should be noted that the curved segment 6 is always constituted by a half-shell, of semi-toric form, having a direct connection with arms 2 and 7. Consequently, this half-shell offers considerable mechanical strength and may, without risk of deformation, withstand the pulling efforts exerted on one or the other of the arms having a tendency to separate them, particularly during maneuvers and manipulations for disconnecting the arm 7 from the complementary element of the distributor or other member using the electrical energy distributed.

By way of indication, the above-described terminal is made by being stamped from a blank made of appropriate raw material, such as brass, galvanized steel, stainless steel, by means of a gang die.

In the example of FIGS. 7 and 8, the complementary part may be constituted by polyamide or other plastic material or appropriate elastomer, to form the torus 27, and steel or brass wire may form spring 30.

The invention is not limited to the embodiments described and shown hereinabove, as various modifications may be made thereto without departing from the scope thereof.

What is claimed is:

1. A bent terminal for electrical connection comprising an arm for crimping and for connecting electrically with a conductor, a substantially tubular arm elastically deformable radially for connecting with a complementary terminal and a bent portion of fixed shape joining said arms, the bent portion comprising a curved segment defining an envelope of generally toric form, the envelope having a cross-section substantially equal to that of the tubular arm; said envelope having a radius of curvature, taken at the level of the inner generatrix for the toric form, of the order of one to three times the diameter of the tubular arm; the envelope further being a continuation of the tubular arm; said curved segment including a first half-shell affixed to the arms and having curved inner and outer edges formed about a common center point, with the inner edge being interposed between the outer edge and the center point; said curved segment also comprising a plurality of tongues extending from the outer edge of the half-shell, the tongues being rolled and bent towards the center of the envelope and contacting the inner edge of the half-shell.

2. The terminal of claim 1 in which the arms and first half-shell are integrally formed from a single piece of sheet material.

3. The terminal of claim 2, wherein the first half-shell is semi-toric and the plurality of tongues constitute a complementary portion of the curved segment integrally formed with the first half-shell for forming the envelope.

4. The terminal of claim 1 in which the arms and bent portion are integrally formed from a single piece of sheet material.

5. The terminal of claim 4 wherein the first half-shell is semi-toric and the plurality of tongues constitute a complementary portion of the curved segment integrally formed with the first half-shell for forming the envelope.

6. A bent terminal for electrical connection comprising an arm for crimping and for connecting electrically with a conductor, a substantially tubular arm elastically deformable radially for connecting with a complementary terminal and a bent portion of fixed shape joining said arms, the bent portion comprising a curved segment defining an envelope of generally toric form, the envelope having a cross-section substantially equal to that of the tubular arm; said envelope having a radius of curvature, taken at the level of the inner generatrix for the toric form, of the order of one to three times the diameter of the tubular arm; the envelope further being a continuation of the tubular arm; said curved segment including a first half-shell affixed to the arms and having curved inner and outer edges formed about a common center point, with the inner edge being interposed between the outer edge and the center point; said first half-shell being semi-toric; said curved segment also including a complementary portion connected to the first half-shell for forming the envelope; said complementary portion comprising tongues extending from the outer edge of the first half-shell, the tongues being rolled and bent towards the center of the envelope and contacting the inner edge of the half-shell.

* * * * *